US005451921A

United States Patent [19]

Crawford et al.

[11] Patent Number: 5,451,921

[45] Date of Patent: Sep. 19, 1995

[54] ELECTRICAL DEVICES

[75] Inventors: Tracy Crawford, Mountain View; Jim D. Beckham, San Mateo; Andrew D. White, Manteca, all of Calif.

[73] Assignee: Raychem Corporation, Menlo Park, Calif.

[21] Appl. No.: 131,791

[22] Filed: Oct. 4, 1993

[51] Int. Cl.[6] ..... H01C 10/16

[52] U.S. Cl. ..... 338/220; 338/221; 338/316; 338/332; 338/22 R

[58] Field of Search ..... 338/220, 221, 316, 332, 338/22 R; 439/620

[56] References Cited

U.S. PATENT DOCUMENTS

| | | | |
|---|---|---|---|
| 3,750,082 | 7/1973 | Petersen et al. | 338/220 |
| 3,914,007 | 10/1975 | Seidler | 339/225 P |
| 4,907,340 | 3/1990 | Fang et al. | 29/610.1 |
| 4,924,204 | 5/1990 | Uchida | 338/22 R |
| 5,049,850 | 9/1991 | Evans | 338/22 R |

FOREIGN PATENT DOCUMENTS

| | | | |
|---|---|---|---|
| 0057171 | 8/1982 | European Pat. Off. | H05B 3/14 |

OTHER PUBLICATIONS

Patent Abstracts of Japan, vol. 12, No. 167 (Abstract of Japanese Patent Application No. 62277759).

International Search Report for PCT/US94/11369, filing date Oct. 4, 1994.

*Primary Examiner*—Marvin M. Lateef

*Attorney, Agent, or Firm*—Timothy H. P. Richardson; Herbert G. Burkard

[57] ABSTRACT

An electrical assembly in which electrical connection is made to a device having two laminar electrodes and a laminar element between the electrodes, preferably a circuit protection device in which a PTC conductive polymer element is sandwiched between two metal foil electrodes. Connection is made to at least one of the electrodes by a resiliently deformed clip having an active arm which contacts one of the electrodes, and a passive arm which is not in conductive contact with the other electrode. Preferably there is an auxiliary member between the active and passive arms of the clip. The auxiliary member can be an insulator, or a conductive member which is spaced apart from the other electrode but secured to the same face of the PTC element as the other electrode.

19 Claims, 4 Drawing Sheets

FIG. 4
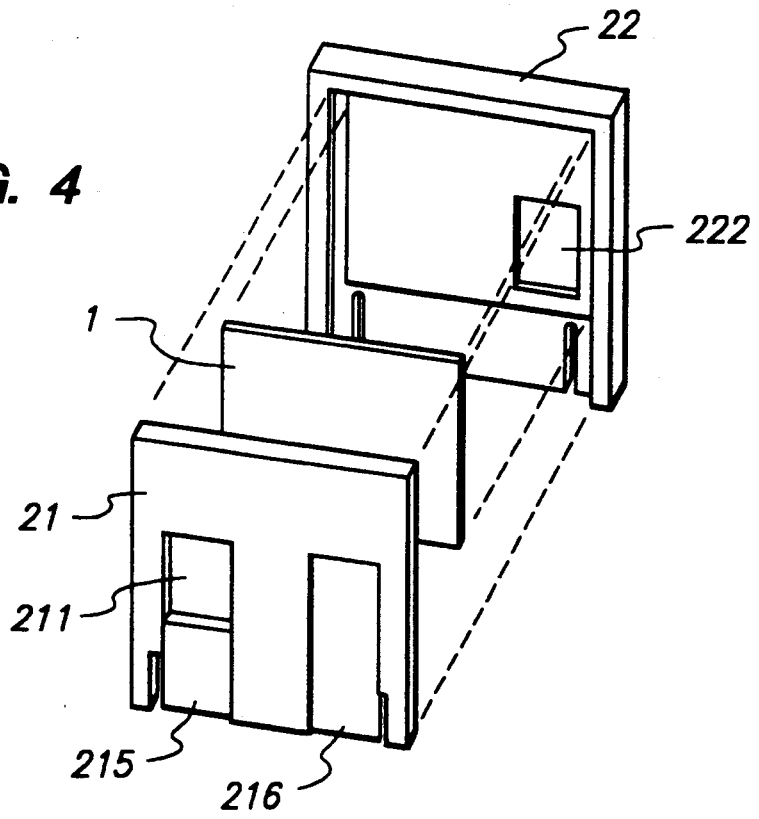
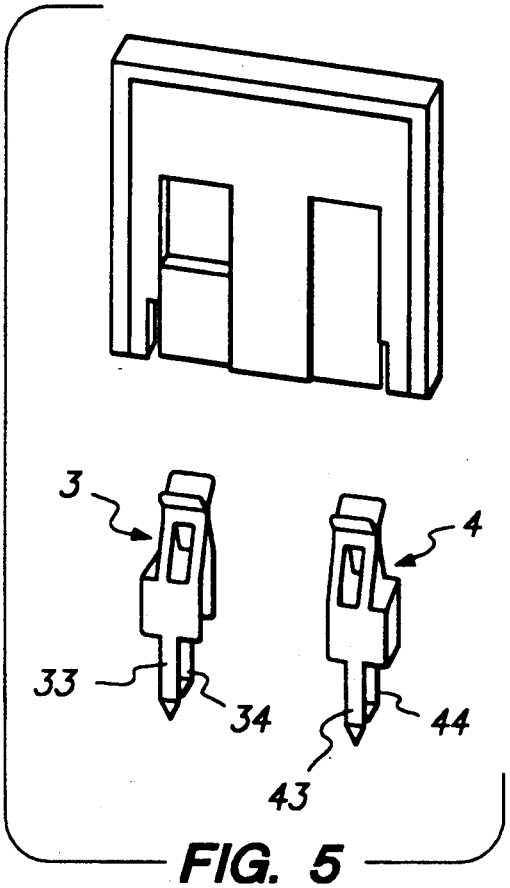
FIG. 5
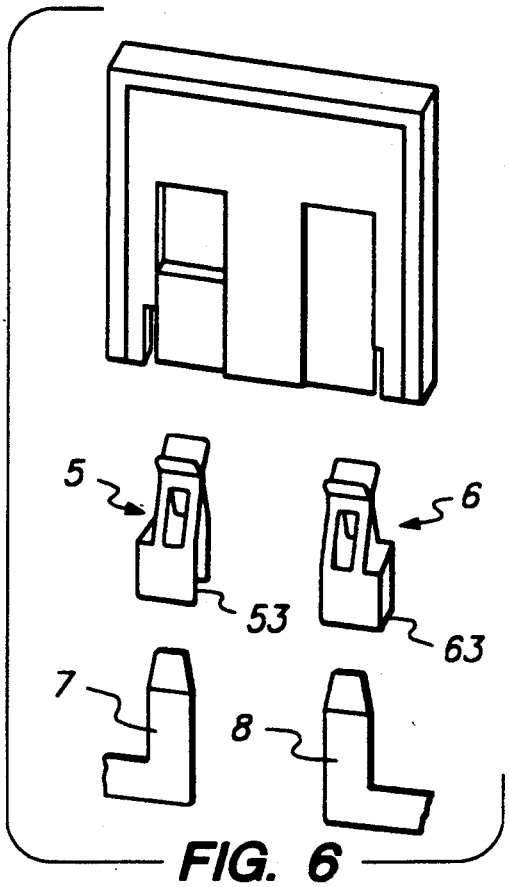
FIG. 6

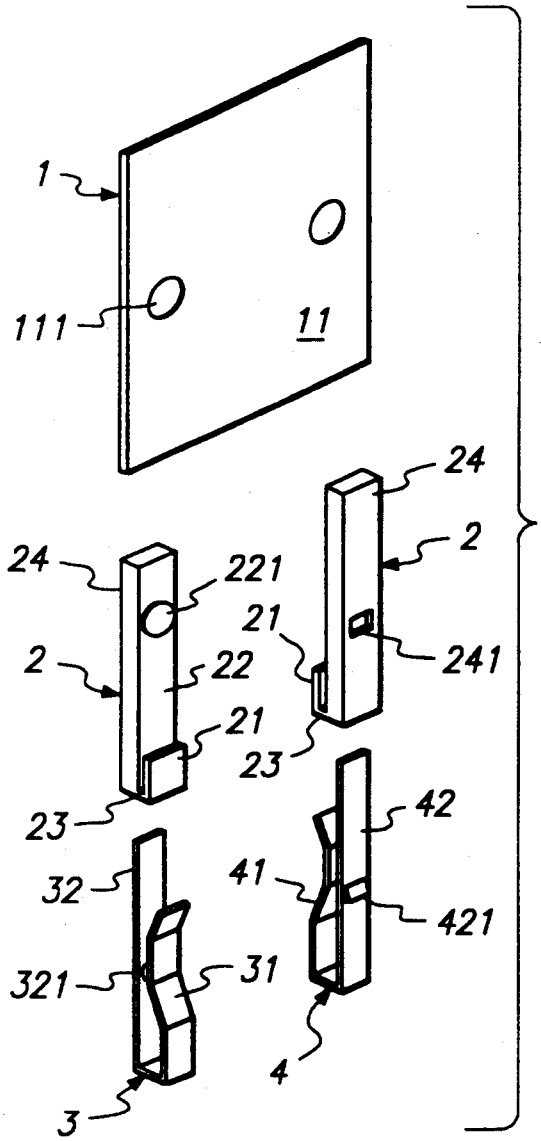
FIG. 7
FIG. 8
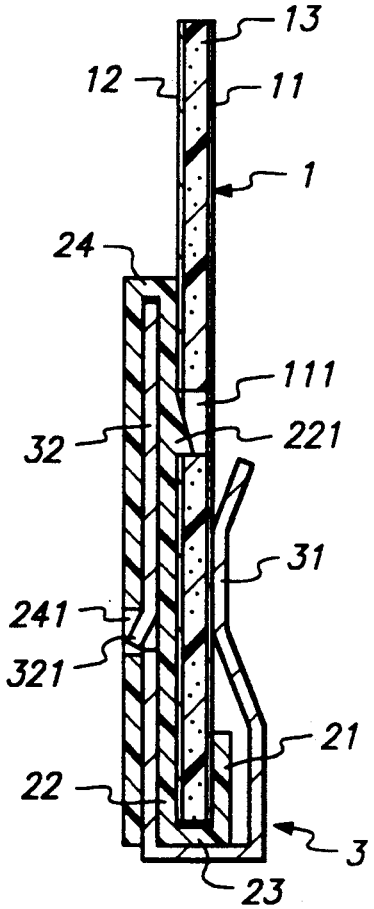

ELECTRICAL DEVICES

CROSS REFERENCE TO RELATED APPLICATIONS

This application is related to copending, commonly assigned U.S. application Ser. No. 07/910,950 filed Jul. 9, 1992, and the corresponding PCT Application US93/06480 filed Jul. 8, 1993 (Docket No. MP1454), and to copending commonly assigned U.S. application Ser. No. 08/121,717, filed Sep. 15, 1993, (Docket No. MP1490-US1). The entire disclosure of each of those applications is incorporated herein by reference.

BACKGROUND OF THE INVENTION

1. Field of the Invention

This invention relates to electrical devices.

2. Introduction to the Invention

Many electrical devices comprise two laminar electrodes and, sandwiched between them, a laminar electrical element which may be a conductor, e.g. a resistive element, as for example in a resistor or a varistor, or a non-conductor, as for example in a capacitor. Particularly useful devices of this type comprise a resistive element which exhibits PTC (positive temperature coefficient) behavior, in particular circuit protection devices which comprise a main portion which is a laminate of two laminar electrodes and, sandwiched between the electrodes, a laminar resistive element which exhibits PTC behavior. The PTC resistive element may be composed of conductive polymer (this term being used to denote a composition comprising a polymer and, dispersed therein, a particulate conductive filler) or a ceramic, e.g. a doped barium titanate. When a conductive polymer is used, such devices are generally prepared by stamping (or otherwise cutting) a plurality of the devices out of a laminate of a sheet of the conductive polymer between two metal foils. When a ceramic is used, such devices are usually prepared by applying liquid electrode material to the major surfaces of a preformed laminar resistive element, and solidifying the liquid electrode material.

Devices of this kind can sometimes be used without the addition of electrical leads, for example by installation between two separate resilient terminals which bear on opposite faces of the device. However, it is difficult to obtain satisfactory results in this way. There is a delicate balance, which must be retained throughout the life of the device, between the minimum pressure needed for good electrical contact and good physical retention, and the maximum pressure that can be tolerated by the device without adverse effect on its properties. This problem is particularly severe when the PTC element is composed of a conductive polymer, because the conductive polymer is liable to creep or otherwise deform under pressure, particularly at elevated temperatures, e.g. when tripped (i.e. when converted into a high resistance high temperature state by a fault).

U.S. Pat. No. 4,924,204 (Uchida), the disclosure of which is incorporated herein by reference, proposes, in view of this problem, to make a laminar PTC conductive polymer device in which there are two offset areas which contain the PTC element and one only of the electrodes (e.g. opposite end areas of a rectangular device), and to connect the device via resilient terminals which bear on the respective electrodes in the areas where there is no opposite electrode. The terminals and the device are placed in an insulating casing which enables the terminals to press resiliently against the device. U.S. Pat. No. 4,924,204 states that the PTC element will not be deformed substantially, even if softened by self-heating, because the resilient forces of the terminals are distributed, and that, should the PTC element be deformed and one of the electrodes bent out of shape, the bent electrode will not contact the other electrode.

SUMMARY OF THE INVENTION

We have discovered, in accordance with the present invention, that, when using an electrical device which comprises two laminar electrodes and a laminar electrical element between them, important advantages can be obtained by making the connection to one of the electrodes (the "first" electrode) through a resilient clip having (a) one arm which is pressed against the device and makes electrical contact with the first electrode but not with the second electrode, and (b) another arm which does not make electrical contact with the second electrode and is pressed towards the first arm through the device. In this way, we have found, it is easy and economical to make a controlled, long lasting and efficient contact to the first electrode, even when the electrical element is a PTC conductive polymer element. In particular, this invention makes it much easier consistently to obtain and maintain a desired pressure on the electrode. Furthermore, it is easy and economical to provide the clip with a terminal which can be connected into a circuit in any desired way. It is often preferred to make the electrical connection to the second electrode by a second clip of the same kind (but arranged, of course, so as to connect to the second electrode). However, the connection to the other electrode can be made in any other convenient way.

In describing the invention, the term "active arm" is used herein to denote an arm of a clip which is in electrical contact with one, but not both, of the electrodes; and the term "passive arm" is used herein to denote the other arm of the clip, i.e. the arm which is not in electrical contact with either of the electrodes, or, as further described below, is in electrical contact with the same electrode as the active arm through an additional conductive element which passes through or around the electrical element.

When this specification states that one component "contacts" or "is in electrical contact with" or "makes electrical contact with" (or the like) another component, this means that when the device is in use, electrical current flows between the two components without passing through the laminar electrical element. Similarly, when this specification states that one component "does not contact," or is not in electrical contact with", or "does not make electrical contact with" another component, this means that when the device is in use, either no substantial current flows between the components (as for example when one of the components is composed of insulating material or when the components are separated by a component of very high resistance) or, if any current flows between the components, the laminar electrical element lies in the path of current flow between the components.

Preferably, the invention makes use of an auxiliary member which is not in electrical contact with the second electrode, and through which the passive arm presses against the active arm. In one embodiment, the auxiliary member is an insulating member which lies between the passive arm of the clip and the second electrode. For example, the auxiliary member can be provided by a carrier which fits to the device and comprises a first laminar member which fits to one side of the device and provides the auxiliary member and a second laminar member which fits to the opposite side of the device and defines a window through which the active arm of the clip contacts the electrode. In another example, the insulating auxiliary member fits to the passive arm of the clip so that the clip can be applied to a device and make contact with only one of the electrodes.

In another embodiment, the auxiliary member is a conductive member which is secured to the same surface of the electrical element as the second electrode but is spaced apart from the second electrode. Such a conductive auxiliary member is preferably a residual member formed by removing a part of one of the electrodes from a device in which the electrodes and the electrical element are coextensive; in this case, partial removal of at least one of the electrodes is necessary, but complete removal of an end portion of the electrode is not desirable, because the residual member helps to distribute the pressure exerted by the clip and can have useful electrical properties, as discussed below.

In a first preferred aspect, this invention provides an electrical assembly which comprises (A) a laminar electrical device which comprises
  (1) a first laminar electrode,
  (2) a second laminar electrode, and
  (3) a laminar PTC element which (a) exhibits PTC behavior, and (b) has a first face to which the first electrode is secured and an opposite second face to which the second electrode is secured; and (B) a clip which (a) is elastically deformed, and (b) comprises
  (1) an active arm which, as a result of elastic deformation of the clip, is pressed against the device and makes electrical contact with one of the electrodes and not with the other electrode, and
  (2) a passive arm which (i) does not make electrical contact with the other electrode, and (ii) as a result of the elastic deformation of the clip, is pressed towards the active arm through the device.

Electrical connection of the clip to the remainder of an electrical circuit can be made in any convenient way, e.g. by soldering, welding, bolting, riveting, gluing (with a conductive adhesive), crimping or clipping (i.e. through an elastically deformed clip). For example the clip can include one or more terminals which are placed in contact with another conductor, e.g. by pushing the terminal into a through hole in a circuit board, and which are then secured to the conductor by soldering, crimping or bolting. Alternatively the clip can include one or more terminals which can be inserted into an elastically deformable terminal so that electrical contact is established and maintained by resilient forces. Alternatively the clip can include an elastically deformable terminal which can be elastically deformed to establish and maintain electrical contact between the clip and another conductor. The other conductor can be, for example, a free-standing conductor such as a metal frett, or a metallic trace on a circuit board, the additional elastically deformable member then being secured to the circuit board as well as the trace.

Usually there will be a single clip connected to each electrode, but as a safety measure or in order to ensure adequate current-carrying capacity, or for desired thermal properties, there can be two or more clips attached to each electrode.

Often the assembly will comprise two clips as described above, one connected to the first electrode and the other connected to the second electrode; the clips will usually be the same (except for the manner in which they are connected), but can be different. However, the connection to the second electrode can be made in some other way, e.g. by soldering, welding, bolting, riveting, gluing, crimping or clipping. For example in one embodiment of the invention, the clip includes a resilient clamping member which can be secured to a substrate so that the second electrode is forced into resilient contact with another conductor, e.g. a metallic trace on a circuit board. The clamping member can also function as an elastically deformable terminal which establishes and maintains electrical contact between the clip and another conductor.

When the assembly includes a clip as described and an associated auxiliary member which is provided by an insulating carrier which fits to the device and defines a window through which the active arm of the clip is connected to an electrode of the device, a combination of the device and the auxiliary member, without the clip, is novel and forms part of the present invention. Thus in a second preferred aspect, this invention provides an electrical assembly which comprises (A) a laminar electrical device as defined above (B) a carrier member which
  (1) fits to the device,
  (2) is composed of an insulating material, and
  (3) comprises
    (a) a first laminar portion which is (i) adjacent to the first electrode and (ii) comprises a first insulating section and a first window section, the first electrode being exposed for electrical connection in the first window section,
    (b) a second laminar portion which (i) is adjacent to the second electrode and (ii) comprises a second insulating section opposite the first window section, and
    (c) a third portion which connects the first and second portions, e.g. by wrapping around an edge of the device or by passing through the device.

When the assembly includes an auxiliary member which is an insulating member which fits to the passive arm of a clip, thus making it possible to apply the clip to the device and make contact with only one of the electrodes, the combination of the clip and the auxiliary member, without the device, is novel and forms part of the present invention. Thus in a third preferred aspect, this invention provides an electrical clip which comprises (1) a first conductive arm,
(2) a second conductive arm,
(3) an insulating member which fits to the second conductive arm, and
(4) a terminal for connecting the clip to another conductor, e.g. a through hole in a circuit board or a metal frett or other bus conductor, the clip being elastically deformable so that it will clip over a laminar electrical device as defined above with the first and second arms pressing against each other through the laminar device and the insulating member.

The invention also includes electrical circuits which comprise an assembly or a clip according to the first, second or third aspect of the invention, and methods of making assemblies according to the first aspect of the invention in which an edge of the laminar device is pushed between the arms of the clip.

A BRIEF DESCRIPTION..OF THE DRAWING

The invention is illustrated in the accompanying drawings, in which

FIGS. 1–6 illustrate assemblies in which the auxiliary member is an insulating member which fits around the device;

FIGS. 7–8 illustrate assemblies in which the auxiliary member is an insulating member which fits around the clip.

DETAILED DESCRIPTION OF THE INVENTION

Figure 1:
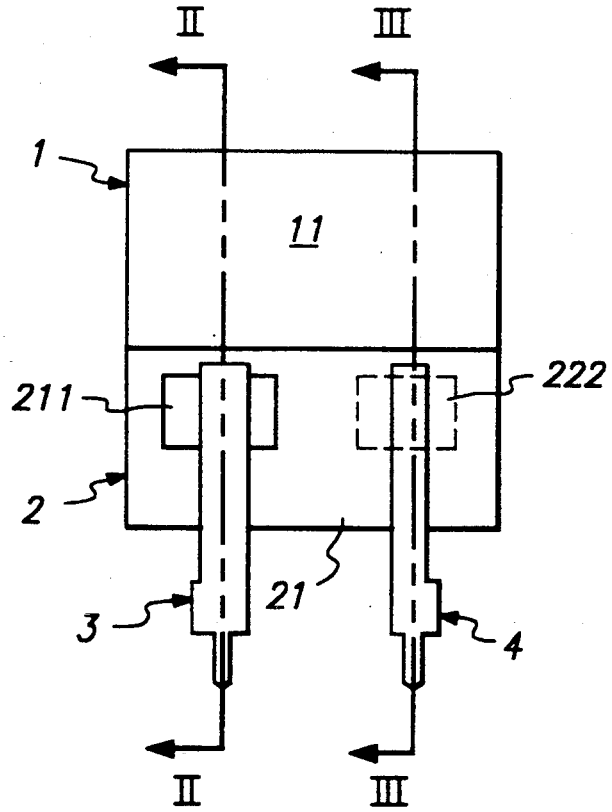

The invention is described below chiefly by reference to PTC circuit protection devices which comprise a laminar PTC element composed of a PTC conductive polymer and two laminar electrodes secured directly to the PTC element, and to the production of such devices. It is to be understood, however, that the description is also applicable, insofar as the context permits, to other electrical devices containing PTC conductive polymer elements, to electrical devices containing PTC ceramic elements, and to other electrical devices comprising two laminar electrodes and an electrical element sandwiched between them. When the description below makes reference to a first clip in which the active arm contacts the first electrode and the passive arm does not contact the second electrode, it is to be understood that the description is also applicable to a second clip which is part of an assembly containing two clips and in which the active arm contacts the second electrode and the passive arm does not contact the first electrode. Similarly, where reference is made to a first auxiliary member which is associated with a first clip, the description is also applicable to a second auxiliary member which is associated with a second clip.

As described and claimed below, and as illustrated in the accompanying drawings, the present invention can make use of a number of particular features. Where such a feature is disclosed in a particular context or as part of a particular combination, it can also be used in other contexts and in other combinations, including, for example, other combinations of two or more such features.

PTC Compositions

The PTC compositions used in the present invention are preferably conductive polymers which comprise a crystalline polymer component and, dispersed in the polymer component, a particulate filler component which comprises a conductive filler, e.g. carbon black or a metal. The filler component may also contain a non-conductive filler, which changes not only the electrical properties of the conductive polymer but also its physical properties. The composition can also contain one or more other components, e.g. an antioxidant, crosslinking agent, coupling agent or elastomer. For use in circuit protection devices, the PTC composition preferably has a resistivity at 23° C. of less than 50 ohm-cm, particularly less than 10 ohm-cm, especially less than 5 ohm-cm. Suitable conductive polymers for use in this invention are disclosed for example in U.S. Pat. Nos. 4,237,441 (van Konynenburg et al), 4,304,987 (van Konynenburg), 4,388,607 (Toy et al), 4,514,620 (Cheng et al), 4,534,889 (van Konynenburg et al), 4,545,926 (Fouts et al), 4,560,498 (Horsma et al), 4,591,700 (Sopory), 4,724,417 (Au et al), 4,774,024 (Deep et al), 4,935,156 (van Konynenburg), and 5,049,850 (Evans et al), and copending, commonly assigned U.S. patent application Ser. No. 07/893,626 (Chandler et al, filed Jun. 5, 1992). The disclosure of each of these patents and applications is incorporated herein by reference.

The PTC resistive element is preferably a laminar element, and can be composed of one or more conductive polymer members, at least one of which is composed of a PTC material. When there is more than one conductive polymer member, the current preferably flows sequentially through the different compositions, as for example when each composition is in the form of a layer which extends across the whole device. When there is a single PTC composition, and the desired thickness of the PTC element is greater than that which can conveniently be prepared in a single step, a PTC element of the desired thickness can conveniently be prepared by joining together, e.g. laminating by means of heat and pressure, two or more layers, e.g. melt-extruded layers, of the PTC composition. When there is more than one PTC composition, the PTC element will usually be prepared by joining together, e.g. laminating by means of heat and pressure, elements of the different compositions. For example, a PTC element can comprise two laminar elements composed of a first PTC composition and, sandwiched between them, a laminar element composed of a second PTC composition having a higher resistivity than the first.

When a PTC device is tripped, most of the voltage dropped over the device is normally dropped over a relatively small part of the device which is referred to as the hot line, hot plane or hot zone. In the devices of the invention, the PTC element can have one or more features which help the hot line to form at a desired location, usually spaced apart from both electrodes. Suitable features of this kind for use in the present invention are disclosed for example in U.S. Pat. Nos. 4,317,027 and 4,352,083 (Middleman et al), 4,907,340 and 4,924,072 (Fang et al), the disclosures of which are incorporated herein by reference.

Laminar Electrodes

Particularly useful devices of the invention comprise two metal foil electrodes, and a PTC conductive polymer element sandwiched between them, especially such devices which are used as circuit protection devices and have low resistance at 23° C., generally less than 50 ohm, preferably less than 15 ohm, more preferably less than 10 ohm, particularly less than 5 ohm, especially less than 3 ohm. Particularly suitable foil electrodes are microrough metal foil electrodes, including in particular electrodeposited nickel foils and nickel-plated electrodeposited copper foil electrodes, in particular as disclosed in U.S. Pat. Nos. 4,689,475 (Matthiesen) and 4,800,253 (Kleiner et al), the disclosure of each of which is incorporated herein by reference. A variety of laminar devices which can be used in the present invention are disclosed in U.S. Pat. Nos. 4,238,812 (Middleman et al), 4,255,698 (Simon), 4,272,471 (Walker), 4,315,237 (Middleman et al), 4,317,027 (Middleman et al), 4,330,703 (Horsma et al), 4,426,633 (Taylor), 4,475,138 (Middleman et al), 4,724,417 (Au et al), 4,780,598

(Fahey et al), 4,845,838 (Jacobs et al), 4,907,340 (Fang et al), and 4,924,074 (Fang et al), the disclosure of each of which is incorporated herein by reference. The electrodes can be modified so as to produce desired thermal effects.

The electrodes are preferably secured directly to the PTC resistive element.

Clips

The clips which are used in this invention are generally composed entirely of metal. However, part or all of the clip can be composed of other material, providing that the necessary electrical connection can be made to the electrode and to the remainder of the circuit. The clip is preferably of unitary construction, e.g. composed of a single piece of metal, or two or more pieces of metal rigidly secured together, because it is otherwise very difficult to get consistent pressure between the active and passive arms. The clip can be elastically (i.e. resiliently) deformable not only so as to provide active and passive arms as defined, but also so as to produce other useful results. For example the clip can provide a resilient terminal for connection to another conductor and/or a resilient clamping member to secure the assembly in a desired location, e.g. on a circuit board. When the assembly contains only one clip, the clip can include a clamping member for resiliently pressing the second electrode against another conductor, for example for clamping the assembly to a printed circuit board and forcing the second electrode against a conductive trace on the circuit board. The clip also provides a means for electrically connecting the assembly into a circuit, for example a socket, or a pin.

The active and passive arms of the clip preferably exert pressure on the device substantially at right angles to the plane of the device, e.g. at an angle of not less than 75°. Preferably the pressures exerted on the device by the arms of the clip are substantially directly opposed to each other, i.e. are on substantially the same line, e.g. along lines separated by at most 10 mm. The maximum normal pressure which can be exerted on the device, without adverse effect on the performance of the device, depends upon the nature of the PTC material and the electrode and the auxiliary member (if present). For PTC conductive polymers, especially when they are not crosslinked or are lightly crosslinked (e.g. by exposure to up to about 20 Mrad of ionizing radiation), the normal pressure is preferably less than 100 psi (7 kg/cm$^2$), e.g. 70 to 90 psi (4.9 to 6.3 kg/cm$^2$) at 23° C. When the assembly is exposed to vibration, e.g. in an automobile, this may not be sufficient to hold the device in place. However, as described below, any problem of this kind can readily be solved through the use of retaining members which snap into position when the components are assembled (a so-called "inertial latch mechanism").

Those skilled in the art of making resilient clips will have no difficulty, having regard to the disclosure in this specification and their own knowledge, in designing and making clips suitable for use in this invention.

The thermal properties of the clip can have an important influence on the way in which the device will respond to excessive currents and/or temperature.

Insulating Auxiliary Members

In many assemblies of the invention, the first auxiliary member is an insulating member which lies between the passive arm of the first clip and the second electrode, and thus prevents electrical contact between the clip and the second electrode. The auxiliary member preferably comprises an insulating polymeric material, and may consist of such material.

The insulating auxiliary member is preferably fitted to the device, or to the passive arm of the clip, before the device is placed in the clip. When the auxiliary member is fitted to the device, it is preferably a part of a carrier which comprises a first portion which contacts the first electrode, a second portion which contacts the second electrode and comprises the auxiliary member, and a third portion which joins the first and second portions, e.g. by wrapping around at least one edge of the device, or by passing through the device. If, as is preferred, the first portion extends over the area to be contacted by the first electrode, then it should define a window through which the active arm of the clip makes contact with the first electrode. When the assembly includes two clips, the assembly preferably includes an insulating carrier member which provides both auxiliary members, preferably a carrier member which is composed of an insulating polymeric material and which comprises (a) a first laminar portion which provides the first auxiliary member, (b) a second laminar portion which provides the second auxiliary member, and (c) a third portion which connects the first and second portions, e.g. which wraps around at least one edge of the device or passes through the device, especially such a carrier in which the first portion defines a first window through which the active arm of the first clip makes contact with the first electrode, and the second portion defines a second window through which the active arm of the second clip makes contact with the second electrode.

The carrier member can also provide other useful functions. For example, it can provide an enclosure which protects the PTC device from physical damage, either by enclosing it completely or by protecting parts thereof, e.g. its periphery, which are liable to damage during production or use of the assembly. The carrier is preferably spaced apart from at least a part of the periphery of the device. The carrier can be provided by a single piece of shaped polymer or by two or more pieces which fit together, e.g. around the device. The carrier can also provide members for locating the assembly in automated machinery and/or for making the assembly easy to grasp and/or for positioning the assembly, e.g. one or more channels which guide a clip to a desired position.

In another embodiment, the auxiliary member is an insulating member which fits to, preferably over, one member of the resilient clip, so that when a device is positioned in the clip, only one arm of the clip is in electrical contact with the device.

The thermal properties of the auxiliary member can have an important influence on the way in which the device will respond to excessive currents or temperatures. The auxiliary member can include metal portions for this purpose.

Conductive Auxiliary Members

In another important class of assemblies of the invention, the auxiliary member is a laminar conductive member which is secured to the second face of the PTC element and is spaced apart from the second electrode. Such an auxiliary member is preferably formed by removing a strip of electrode material from a device comprising two laminar electrodes and a PTC element between them, thus creating an isolated residual area of electrode material which is no longer connected to the electrode. The use of such a laminar conductive auxiliary member ensures that the PTC material does not heat up in the area of the clip, thus lessening the danger that the PTC element will deform under pressure from the clip. The auxiliary member also spreads out the load exerted by the clip.

Transverse Members

A number of benefits can be obtained from the use of a transverse member which runs between the first electrode and the second surface of the PTC element, through the PTC element. In one embodiment, the presence of the transverse member substantially increases the pressure which the device will tolerate without harmful deformation, between the active and passive arms of the clip, preferably at least when the PTC element is in a high temperature high resistance state. In another embodiment, the transverse member is electrically conductive and connects the first electrode and a conductive auxiliary member, and thus provides another region for electrical contact between the clip and the first electrode. Under these circumstances, either or both of the arms of the clip can provide the electrical connection to the electrode. The conductive transverse member can for example be a rivet or a plated throughhole. For further details of modified devices containing conductive auxiliary members and conductive transverse members, and their production, reference should be made to application No. 08/121,717 incorporated herein by reference.

In another embodiment, the assembly includes a generally U-shaped conductive member which is secured to the first electrode and a conductive auxiliary member and which extends from the periphery of the device, thus providing guidance when the device is being inserted into a clip.

Coupling Elements

One of the merits of the present invention is that the device, and/or the clip, and/or the auxiliary member can be provided with coupling elements which engage each other when the device, the auxiliary member and the clip are in the desired position, and which preferably substantially increase the force needed to extract the device from the clip.

DETAILED DESCRIPTION OF THE DRAWING

Figure 2:
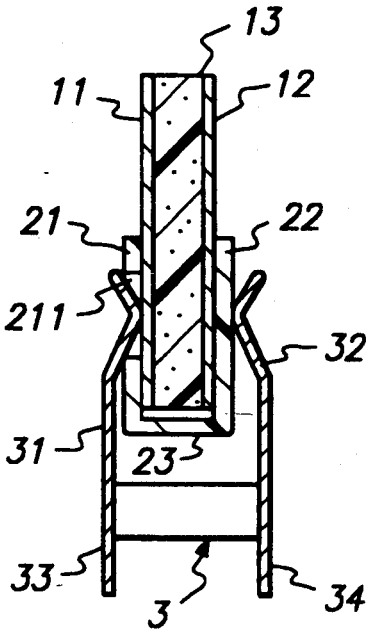
Figure 3:
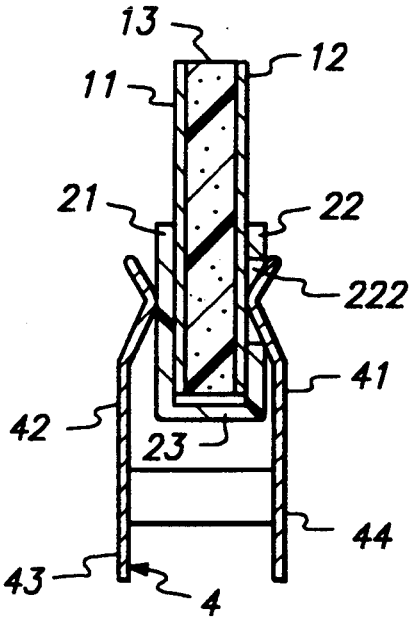

FIGS. 1, 2 and 3 show a laminar electrical device 1, a polymeric insulating carrier member 2, a first metal clip 3, and a second metal clip 4. The electrical device 1 comprises a first electrode 11, a second electrode 12, and a PTC conductive polymer element 13. The carrier 2 comprises a first laminar portion 21 which contacts the first electrode 11, a second laminar portion 22 which contacts the second electrode 12, and a third edge portion 23 which wraps around, but is spaced apart from, the edge of the device 1. Laminar portion 21 defines a first window 211 and laminar portion 22 defines a second window 222. The first clip 3, which is elastically deformed, has a first active arm 31 which, as a result of the elastic deformation, is pressed against the first electrode 11 through the window 211, and first passive arm 32 which, as a result of the elastic deformation of the clip, is pressed against portion 22 of the insulating carrier 2. The second clip 4, which is elastically deformed, has a second active arm 41 which, as a result of the elastic deformation, is pressed against the second electrode 12 through the window 222, and a second passive arm 42, which, as a result of the elastic deformation of the clip, is pressed against the insulating portion 22. The bottom edges of the windows 211 and 222 provide detents which increase the force needed to extract the device from the carrier. The clips 3 and 4 also include terminals 33, 34 and 43, 44 respectively for mounting the clips in a printed circuit board.

FIG. 4 is an exploded view of an assembly which is similar to that shown in FIGS. 1–3, but in which the carrier is in two interlocking parts and there are channels 215 and 216 on the first laminar portion 21 (and similarly, but not shown, on the second laminar portion 22) to locate the clips when the device is inserted into the clips. FIGS. 5 and 6 show the assembly of FIG. 4 ready for insertion into clips 3,4 (FIG. and 5, 6 (FIG. 6). Clips 3 and 4 have terminals 33,34 and 43,44 for insertion into a circuit board, and clips 5 and 6 have terminals 53, 63 for connection to metal fretts 7,8.

The assembly shown in FIGS. 4, 5 and 6 is an example of a preferred class of assemblies of the invention, namely those which comprise (A) a laminar circuit protection device which comprises
  (1) a first laminar electrode,
  (2) a second laminar electrode, and
  (3) a laminar PTC element which (a) is composed of a conductive polymer composition exhibiting PTC behavior, and (b) has a first face to which the first electrode is secured and an opposite second face to which the second electrode is secured;

(B) a first auxiliary member which (a) is positioned adjacent to the first face of the PTC element, and (b) is not in electrical contact with the first electrode;

(C) a second auxiliary member which (a) is positioned adjacent to the second face of the PTC element, and (b) is not in electrical contact with the second electrode;

(D) a first clip which (a) is elastically deformed, and (b) comprises
  (1) a first active arm which, as a result of elastic deformation of the clip, is pressed against the first electrode and makes physical and electrical contact with the first electrode,
  (2) a first passive arm which (i) does not make electrical contact with the second electrode, and (ii) as a result of elastic deformation of the first clip, is pressed towards the first active arm through the second auxiliary member and the electrical device, and
  (3) a first terminal for connecting the first clip to another conductor; and (E) a second clip which is elastically deformed and which comprises
  (1) a second active arm which, as a result of elastic deformation of the clip, is pressed against the second electrode and makes physical and electrical contact with the second electrode,
  (2) a second passive arm which (i) does not make electrical contact with the first electrode, and (ii) as a result of elastic deformation of the second clip, is pressed towards the second active arm through the first auxiliary member and the electrical device, and
  (3) a second terminal for connecting the second clip to another conductor.

FIG. 7 is an exploded view, and FIG. 8 a cross sectional view, of an assembly in which contact between the passive arm of a clip and an electrode is prevented by means of an insulating member which is secured to the clip.

FIGS. 7 and 8 show a device 1, clips 3,4, and insulating auxiliary members 2. Each of clips 3,4 includes an active arm (31,41) and a passive arm (32,42) and each is associated with an insulating auxiliary member 2. Each of the insulating auxiliary members comprises a laminar portion 22 which lies between the passive arm and one of the electrodes and is part of a hollow section 24 which fits over the passive arm of the clip. Each clip also includes a laminar portion 21 which contacts the opposite electrode and a third portion 23 which wraps around but is spaced apart from the edge of the device. The outer wall of the hollow section 24 has a recess 241 for engaging tab 321, 421 on the clip. The member 22 has a tab 221 for engaging a recess 111 in the device 1.

Figure 9:
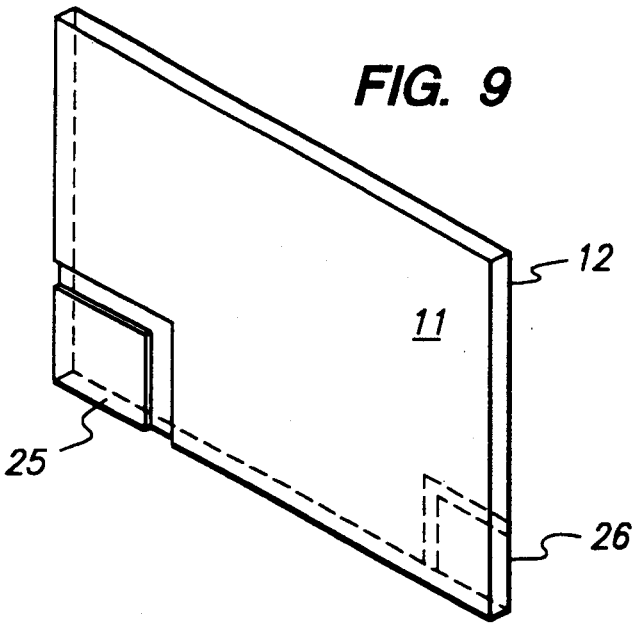
FIGS. 9–11 illustrate devices in which the auxiliary member is a laminar conductive member secured to a surface of the PTC element.
Figure 10:
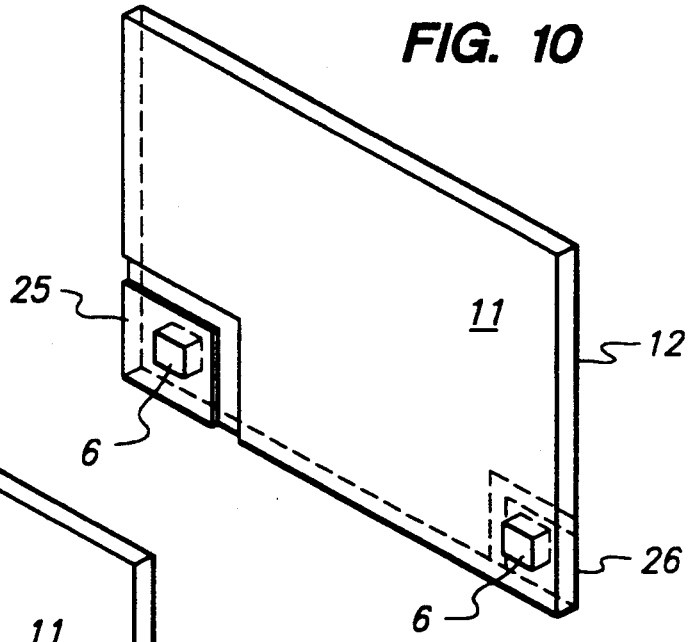
Figure 11:
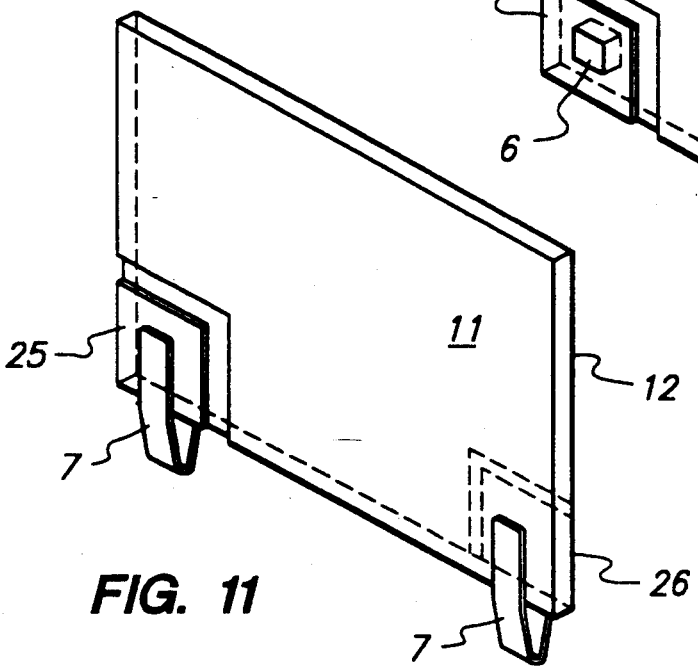

FIGS. 9, 10 and 11 show devices in which the auxiliary member is a laminar conductive member which is secured to the second surface of the PTC element and is spaced apart from the second electrode. In each of these devices, there are laminar conductive members 25,26, which are secured to respective surfaces of the PTC element and are spaced apart from the electrodes secured to those surfaces. In FIG. 10, a conductive stanchion, e.g. a rivet, connects the conductive member 25,26 to the electrode on the opposite face. In FIG. 11 conductive members 7 are secured to the conductive members 25,26 and to the electrode on the opposite face and provide guidance when the device is being inserted into a spring clip.

We claim:

1. An electrical assembly which comprises (A) a laminar electrical device which comprises
  (1) a first laminar electrode,
  (2) a second laminar electrode, and
  (3) a laminar PTC element which (a) exhibits PTC behavior, and (b) has a first face to which the first electrode is secured and an opposite second face to which the second electrode is secured; and (B) a clip which (a) is elastically deformed, and (b) comprises p1 (1) an active arm which, as a result of elastic deformation of the clip, is pressed against the device and makes electrical contact with one of the electrodes and not with the other electrode, and
  (2) a passive arm which (i) does not make electrical contact with said other electrode, and (ii) as a result of the elastic deformation of the clip, is pressed towards the active arm through the PTC element.

2. An assembly according to claim 1 wherein (1) the active arm is pressed against the first electrode; (2) the assembly comprises an auxiliary member which (a) is positioned adjacent to the second face of the PTC element, and (b) is not in electrical contact with the second electrode; and (3) the passive arm contacts the auxiliary member and is pressed towards the active arm through the auxiliary member.

3. An assembly according to claim 2 wherein the auxiliary member (a) lies between the passive arm and the second electrode, and (b) comprises an insulator which prevents electrical contact between the passive arm and the second electrode.

4. An assembly according to claim 3 wherein the auxiliary member is part of a carrier which comprises (a) a first portion which contacts the first electrode and defines a window through which the active arm of the clip makes contact with the first electrode, (b) a second portion which contacts the second electrode and comprises the auxiliary member, and (c) a third portion which connects the first and second portions.

5. An assembly according to claim 3 wherein at least two of the electrical device, the clip, and the auxiliary member include coupling elements which (a) engage each other when the device, the auxiliary member and the clip are in a desired position, and (b) substantially increase the force needed to extract the device from the clip.

6. An assembly according to claim 3 wherein the auxiliary member is secured to the passive arm of the clip.

7. An assembly according to claim 1 which comprises a laminar auxiliary member which (a) is conductive, (b) is secured to the second face of the PTC element, and (c) is spaced apart from the second electrode; and wherein the active and passive arms of the clip are pressed towards each other through the auxiliary member.

8. An assembly according to claim 7 wherein the active arm is pressed against the first electrode and the passive arm is pressed against the auxiliary member.

9. An assembly according to claim 8 which comprises a transverse member which runs between the first electrode and the auxiliary member, through the PTC element, said transverse member having at least one of the following characteristics (a) it substantially increases the pressure which the device will tolerate without harmful deformation, between the active and passive arms of the clip, when the PTC element is in a high temperature high resistance state, and (b) it is conductive and is secured to, and electrically connects, the first electrode and the conductive auxiliary member.

10. An assembly according to claim 1 wherein the PTC element is composed of a conductive polymer.

11. An assembly according to claim 1 wherein the clip is a single piece of metal.

12. An electrical assembly which comprises (A) a laminar circuit protection device which comprises
  (1) a first laminar electrode,
  (2) a second laminar electrode, and
  (3) a laminar PTC element which (a) is composed of a conductive polymer composition exhibiting PTC behavior, and (b) has a first face to which the first electrode is secured and an opposite second face to which the second electrode is secured;

(B) a first auxiliary member which (a) is positioned adjacent to the first face of the PTC element, and (b) is not in electrical contact with the first electrode;

(C) a second auxiliary member which (a) is positioned adjacent to the second face of the PTC element, and (b) is not in electrical contact with the second electrode;

(D) a first clip which (a) is elastically deformed, and (b) comprises
  (1) a first active arm which, as a result of elastic deformation of the clip, is pressed against the first electrode and makes physical and electrical contact with the first electrode,
  (2) a first passive arm which (i) does not make electrical contact with the second electrode, and (ii) as a result of elastic deformation of the first clip, is pressed towards the first active arm through the second auxiliary member and the electrical device, and
  (3) a first terminal for connecting the first clip to another conductor; and (E) a second clip which is elastically deformed and which comprises (1) a second active arm which, as a result of elastic deformation of the clip, is pressed against the second electrode and makes physical and electrical contact with the second electrode, (2) a second passive arm which (i) does not make electrical contact with the first electrode, and (ii) as a result of elastic deformation of the second clip, is pressed towards the second active arm through the first auxiliary member and the electrical device, and (3) a second terminal for connecting the second clip to another conductor.

13. An assembly according to claim 12 wherein (1) the first auxiliary member (a) lies between the second passive arm and the first electrode, and (b) comprises an insulator which prevents contact between the second passive arm and the first electrode, and (2) the second auxiliary member (a) lies between the first passive arm and the second electrode and (b) comprises an insulator which prevents contact between the first passive arm and the second electrode;

and wherein the assembly comprises a carrier member which is composed of an insulating polymeric material and which comprises (a) a first laminar portion which provides the first auxiliary member and defines a first window through which the first active arm makes contact with the first electrode, (b) a second laminar portion which provides the second auxiliary member and defines a second window through which the second active arm makes contact with the second electrode, and (c) a third portion which connects the first and second portions.

14. An assembly according to claim 13 wherein the third portion of the carrier member is wrapped around an edge of the device and is spaced apart from that edge.

15. An assembly according to claim 12 wherein the first auxiliary member is a laminar conductive member which is secured to the first face of the PTC element, and the second auxiliary member is a laminar conductive member which is secured to the second face of the PTC element.

16. An electrical assembly which comprises (A) a laminar electrical device which comprises (1) a first laminar electrode, (2) a second laminar electrode, and (3) a laminar PTC element which (a) exhibits PTC behavior, and (b) has a first face to which the first electrode is secured and an opposite second face to which the second electrode is secured; and (B) a carrier member which (1) fits to the device, (2) is composed of an insulating material, and (3) comprises (a) a first laminar portion which is (i) adjacent to the first electrode and (ii) comprises a first insulating section and a first window section, the first electrode being exposed for electrical connection in the first window section, (b) a second laminar portion which (i) is adjacent to the second electrode and (ii) comprises a second insulating section opposite the first window section, and (c) a third portion which connects the first and second portions.

17. An electrical clip which comprises (1) a first conductive arm, (2) a second conductive arm, (3) an insulating member which fits to the second conductive arm, and (4) a terminal for connecting the clip to another conductor, the clip being elastically deformable so that it will clip over a laminar device with the first and second arms pressing against each other through the laminar device and the insulating member.

18. A clip according to claim 17 wherein the insulating member includes a coupling element which can engage a corresponding coupling element on a device placed in the clip.

19. An electrical circuit which comprises (1) a source of electrical power, (2) an electrical load, and (3) an assembly as claimed in claim 1 which is connected into the circuit by an electrical connection to the clip.

* * * * *

UNITED STATES PATENT AND TRADEMARK OFFICE

CERTIFICATE OF CORRECTION

PATENT NO. : 5,451,921

INVENTOR(S) : Crawford et al.

DATED : September 19, 1995

It is certified that error appears in the above-identified patent and that said Letters Patent is hereby corrected as shown below:

Column 5, line 4, replace "DESCRIPTION..OF" by --DESCRIPTION OF--.

Column 10, line 17, replace "(FIG. and" by --(FIG. 5) and--.

Claim 1, line 10, after "comprises", delete "p1" and begin a new line with "(1) and active".

Signed and Sealed this

Twentieth Day of February, 1996

*Attest:*

*Attesting Officer*

Bruce Lehman

BRUCE LEHMAN

*Commissioner of Patents and Trademarks*